US005924295A

United States Patent [19]

Park

[11] Patent Number: 5,924,295

[45] Date of Patent: Jul. 20, 1999

[54] METHOD AND APPARATUS FOR CONTROLLING INITIAL OPERATION OF REFRIGERATOR

[75] Inventor: Haejin Park, Suwon, Rep. of Korea

[73] Assignee: Samsung Electronics Co., Ltd., Suwon City, Rep. of Korea

[21] Appl. No.: 08/946,361

[22] Filed: Oct. 7, 1997

[51] Int. Cl.[6] ..... F25B 49/00

[52] U.S. Cl. ..... 62/126; 62/130; 62/230; 62/229

[58] Field of Search ..... 62/126, 129, 130, 62/230, 127, 229; 165/11.1; 236/94; 364/184, 187

[56] References Cited

U.S. PATENT DOCUMENTS 4,788,827 12/1988 Otani ..... 62/230 X 5,782,098 7/1998 Hirooka et al. ..... 62/126

*Primary Examiner*—Harry B. Tanner

*Attorney, Agent, or Firm*—Burns, Doane, Swecker & Mathis, L.L.P.

[57] ABSTRACT

When power is supplied to a refrigerator, the refrigerator control system performs one of two different automatic refrigerator temperature setting operations, depending upon whether it is determined that the power is or is not being supplied following a temporary power failure. That determination is made by sensing an internal refrigerator temperature (i.e., a temperature of the cooling compartment and/or the freezing compartment), and providing a reference temperature based upon a sensed external atmosphere temperature. If the refrigerator temperature is less than the reference temperature, then it is assumed that the power is being supplied following a temporary power failure and an appropriate refrigerator temperature setting operation is performed.

10 Claims, 5 Drawing Sheets

METHOD AND APPARATUS FOR CONTROLLING INITIAL OPERATION OF REFRIGERATOR

BACKGROUND OF THE INVENTION

1) Field of the Invention

The present invention relates to a method for controlling an initial operation of a refrigerator and an apparatus therefor, in which when power is applied to the refrigerator, a temperature control condition is automatically set.

2) Prior Art Description

A general household refrigerator is partitioned into a cooler room and a freezer room. Both the cooler room and the freezer room are cooled by cooling air which is produced by an evaporator and supplied by blowing fans when a compressor of a coolant circuit operates. The cooler room and the freezer room are maintained at desired temperatures, by driving the compressor and the blowing fans intermittently. A control circuit for accurately controlling various loads such as a compressor and blowing fans according to peripheral conditions using a variety of processing functions of a microcomputer, is widely adopted in a recent refrigerator. Such a control circuit in the refrigerator has default values involving temperatures pre-programmed in the refrigerator as an operating condition when power is initially applied thereto. That is, if power is newly applied to the refrigerator, the refrigerator operates in such a manner that the temperatures in the cooler room and freezer room are maintained at respective default values. Of course, after the refrigerator starts to run, a user can change the set temperature at his or her will. Each default value constitutes an intermediate value in a respective range of values.

By the way, when power is cut off from the refrigerator due to power failure, bad contact of a power connector, or detachment of a power plug of a values are reset to the default values, respectively. However, the default temperatures may not be low enough to keep the food fresh. Furthermore, since a momentary power failure is not sensed well by a user, he or she may not realize that the temperatures should be reset. Therefore, even though the temperature control condition should be reset in order to maintain the refrigerator at a desired temperature when the refrigerator's operation resumes after a power failure, this is inconvenient to achieve.

As prior art concerned with restart of a refrigerator after power failure, there are Japanese patent laid-open publications 8-303921, 8-313139, 9-79726 and 9-113090. In these prior art references, when power is applied to a refrigerator, the temperatures of a condenser in a coolant circuit and a freezer are measured. Then, when neither of the measured temperatures is higher than predetermined temperatures, the refrigerator can start to run immediately under normal control without pre-operations of a compressor and blowing fans. Accordingly, the temperature in the refrigerator is quickly restored to predetermined temperatures after power failure. However, when power is applied again after power failure, the temperatures set in the refrigerator are not restored to the previous states, which raises a problem in which a user must reset the refrigerator to the desired temperatures.

Meanwhile, the above problem occurring after power failure can be solved by adopting a battery backup device which can maintain a circuit operation even in the power failure. However, it costs much and results in a complicated structure.

SUMMARY OF THE INVENTION

To solve the above problems, it is an object of the present invention to provide a method of controlling an initial operation of a refrigerator in which once power is applied, a previously set temperature control condition is estimated and then the operation of the refrigerator is resumed at the estimated condition, in order to prevent the temperature control condition set in the refrigerator from being changed due to temporary power failure.

It is another object of the present invention to provide an apparatus of controlling an initial operation of a refrigerator in which once power is applied, a previously set temperature control condition is estimated and then the operation of the refrigerator is resumed at the estimated condition, in order to prevent the temperature control condition set in the refrigerator from being changed due to temporary power failure.

To accomplish the above first object of the present invention, there is provided a method for controlling an initial operation of a refrigerator so that the refrigerator is maintained at a set temperature, the method comprising the steps of: checking a temperature in the refrigerator when power is applied; setting a cooling temperature in the refrigerator based on the checked temperature; and resuming an operation of the refrigerator so that the inside of the refrigerator is cooled at the set cooling temperature.

Here, the present invention further comprises the step of checking an external atmosphere temperature of the refrigerator using a separate temperature sensor in order to judge whether the applied power is due to temporary power failure. Also, the step of setting the cooling temperature in the refrigerator is performed when the temperature in the refrigerator is compared with the checked external atmosphere temperature and then the former is equal to or lower than the latter. Also, when the temperature in the refrigerator is higher than the checked external atmosphere temperature, the cooling temperature is set to an intermediate value in a temperature control range.

Particularly, the present invention divides a set range of the cooling temperature into notches of a predetermined interval with one another, in which the cooling temperature is set to a notch which is positioned lower by one notch than the notch to which the checked temperature in the refrigerator belongs.

To accomplish the above second object of the present invention, there is provided an apparatus for controlling an initial operation of a refrigerator having loads such as a compressor and at least one blowing fan for cooling the inside of the refrigerator, the control apparatus comprising: a temperature sensor for measuring the temperature in the refrigerator; a driver for driving the compressor and the blowing fan; and a controller for checking a current temperature in the refrigerator using the temperature sensor immediately after power is applied, setting a cooling temperature in the refrigerator based on the checked temperature of the refrigerator, and controlling driving of the compressor and the blowing fan via the driver so that the inside of the refrigerator is cooled at the set temperature.

The present invention further comprises an external atmosphere temperature sensor for measuring an external atmosphere temperature around the refrigerator in order to judge whether the applied power is due to temporary power failure. Also, the present invention further comprises a display for light-emit-displaying the set cooing temperature and a keypad for altering the cooling temperature. Here, the display and the manipulator can be provided as a single panel.

DETAILED DESCRIPTION OF THE INVENTION

A preferred embodiment of the present invention will be described with reference to the accompanying drawings.

Figure 1:
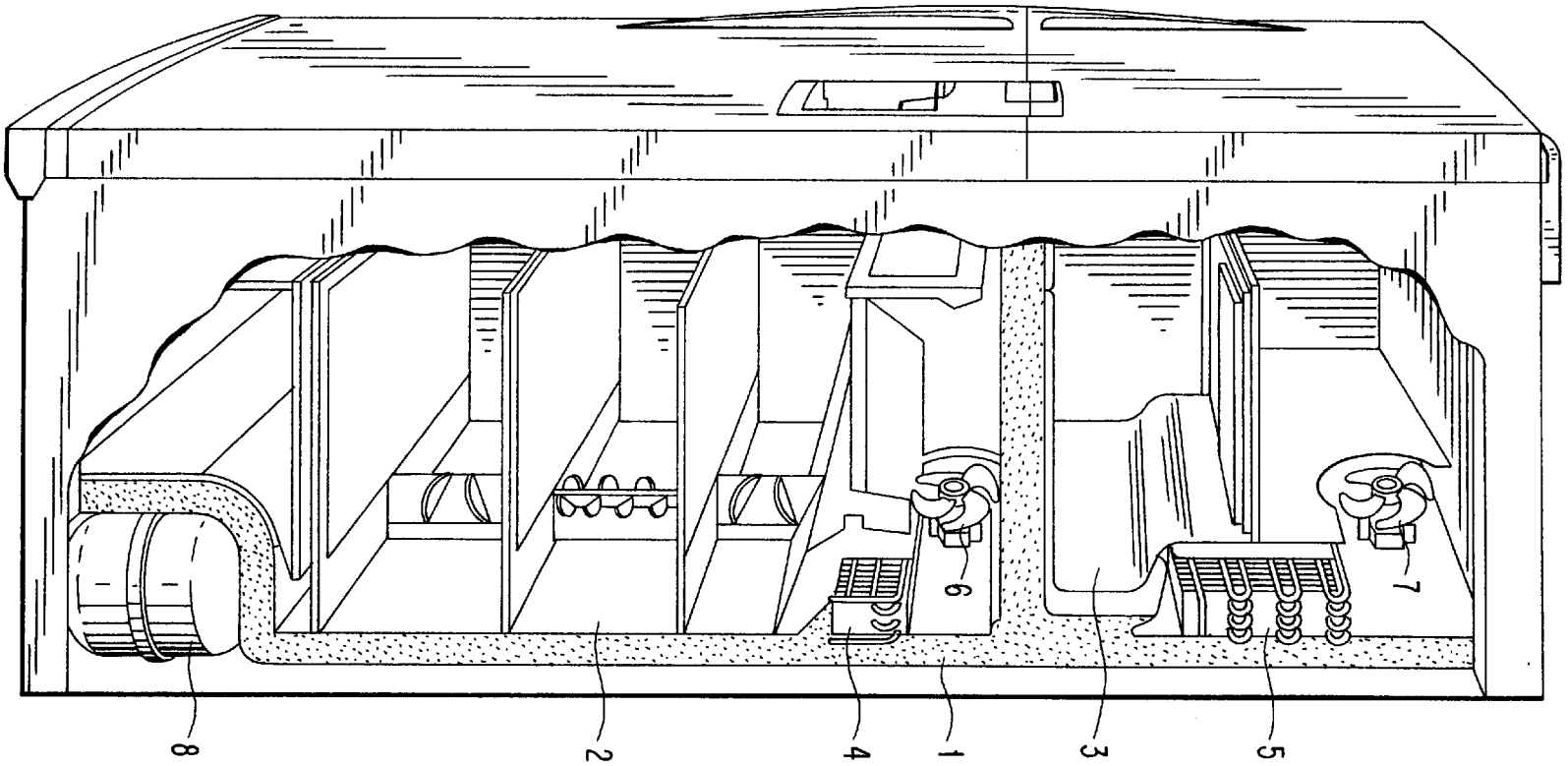
FIG. 1 (PRIOR ART)
FIG. 1 is a partly exploded perspective view of a conventional refrigerator.

In FIG. 1 showing a refrigerator in which the present invention is applied, the refrigerator has an independent cooling system for cooling and freezing, including a high efficiency multi-evaporator (H.M.) cycle. Two evaporators 4 and 5 and two blowing fans 6 and 7 are installed in a cooler 2 and a freezer 3 partitioned in a cabinet 1, respectively. When a compressor 8 is driven, the evaporators 4 and 5 are cooled. At this time, if the blowing fans 6 and 7 are driven, cooling air circulates to independently cool the cooler 2 and the freezer 3.

Figure 2:
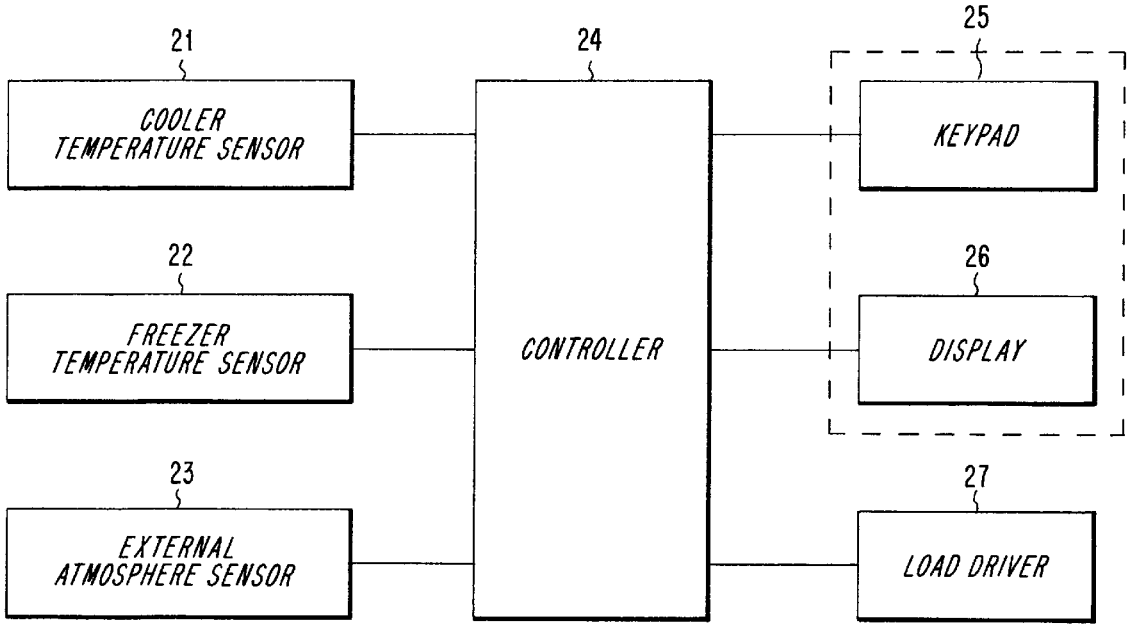
FIG. 2 is a block diagram showing a control circuit of a refrigerator in which a control method for an initial operation of the refrigerator according to the present invention is embodied.
Figure 3:
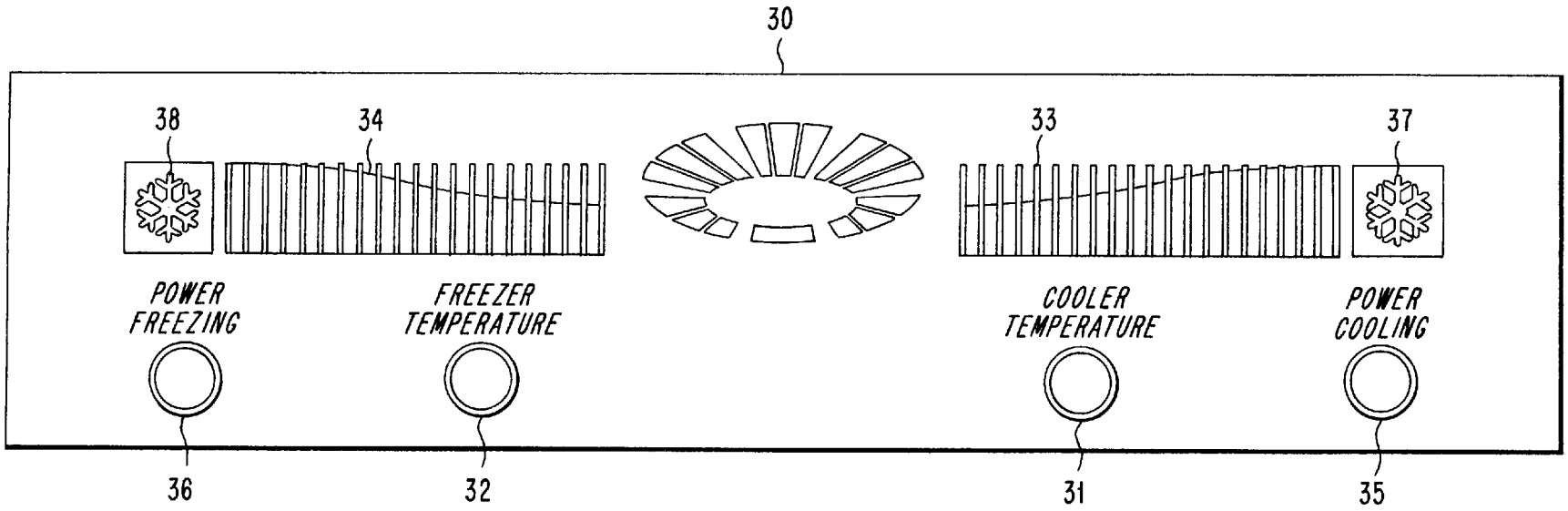
FIG. 3 is a front view of a control panel of the refrigerator.

FIG. 2 shows a control circuit of a refrigerator in which a control method for an initial operation of the refrigerator according to the present invention is embodied. The control circuit shown in FIG. 2 includes sensors 21 and 22 for monitoring temperatures in the refrigerator, that is, a cooler temperature and a freezer temperature, a sensor 23 for sensing an external atmosphere temperature of the refrigerator, a controller 24, a keypad 25 for altering a desired cooling temperature of a user, a display 26 for displaying the set cooling temperature and an operating state thereon, and a load driver 27 for driving loads such as a compressor and blowing fans. Here, the keypad 25 and the display 26 are provided as a single panel 30 as shown in FIG. 3, which is attached to a front door of the body of the refrigerator. The panel 30 includes buttons 31 and 32 for setting the respective temperatures of the cooler and the freezer, lamp arrays 33 and 34 for light-emit-displaying the set temperature range in notch form having a certain interval, buttons 35 and 36 for selecting a power cooling function and a power freezing function, respectively and indication lamps 37 and 38 for indicating the selection of the power cooling function and the power freezing function. The lamp arrays 33 and 34 are sequentially lit up from a "weak" notch to a "strong" notch according to the number of times a user touches the temperature setting buttons 31 and 32, to thereby visually indicate the currently set cooling temperature. If the buttons 31 and 32 are still touched at the state when the lamp arrays 33 and 34 have been lit up to the "strong" notch, all lamps in the lamp arrays 33 and 34 are extinguished and then start again to be sequentially lit up from a "weak" notch.

In the FIG. 2 control circuit, the controller 24, such as a microcomputer, compares the current temperature in the refrigerator detected from the sensors 21 and 22 with the temperature of the notch set by a user via the keypad 25. If the current temperature is equal to or higher than the set notch temperature, the load driver 27 drives the compressor and the blowing fan. If not, a typical control routine is executed so that the load driving stops. Also, if the power cooling button 35 and the power freezing button 36 are selected in the panel 30 of FIG. 3, the controller 24 lights up the respective indication lamps 37 and 38, and sequentially controls the compressor and the cooler blowing fan until the room temperature in the cooler reaches a predetermined temperature (about −4° C.) during power cooling, irrespective of the set notch temperature. During power freezing, a control routine for controlling the compressor and the freezer blowing fan to be driven sequentially for a certain time is executed.

Figure 4A:
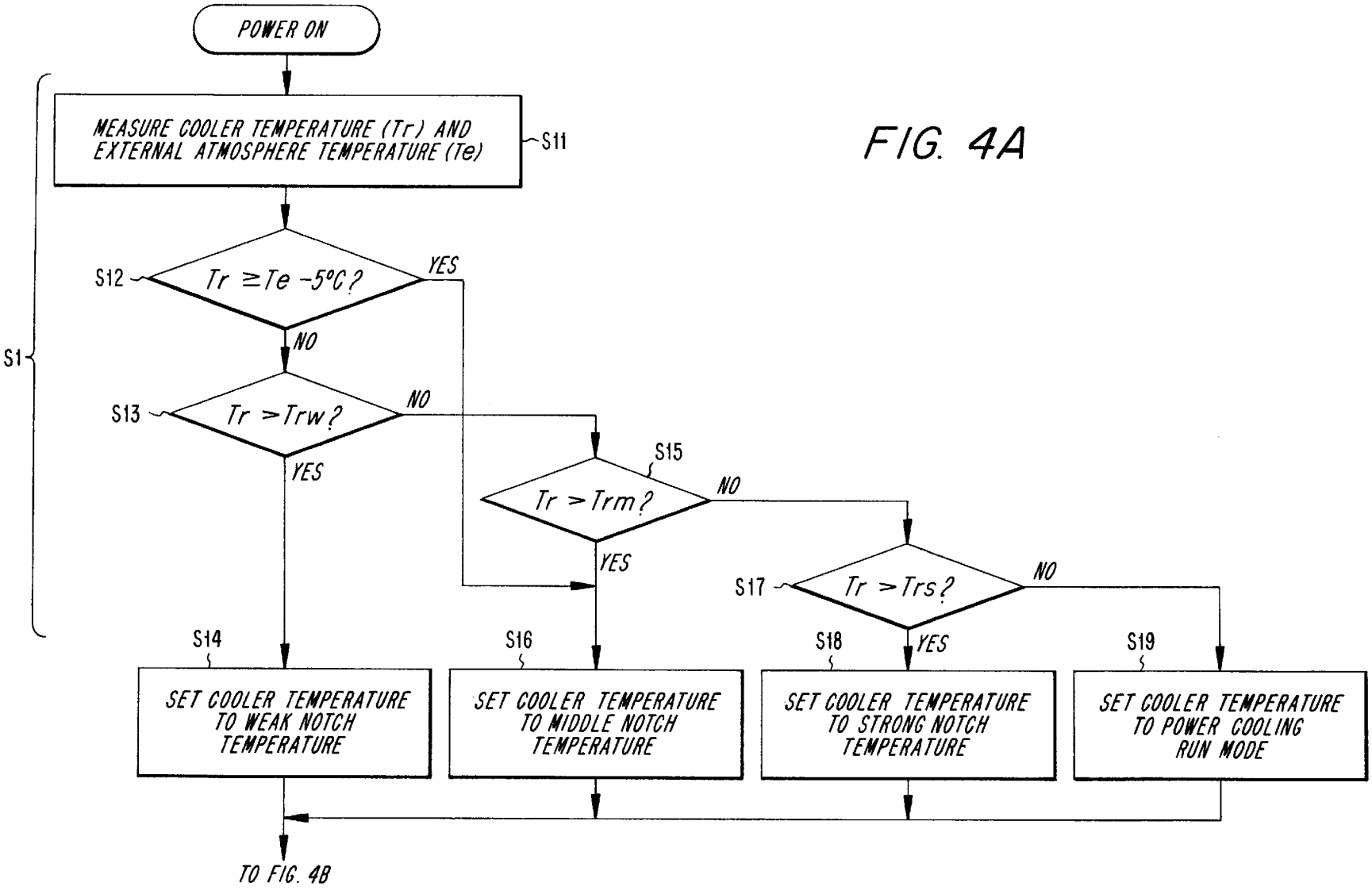
FIGS. 4A, 4B is a flow-chart diagram of a control method for an initial operation in a refrigerator according to the present invention.
Figure 4B:
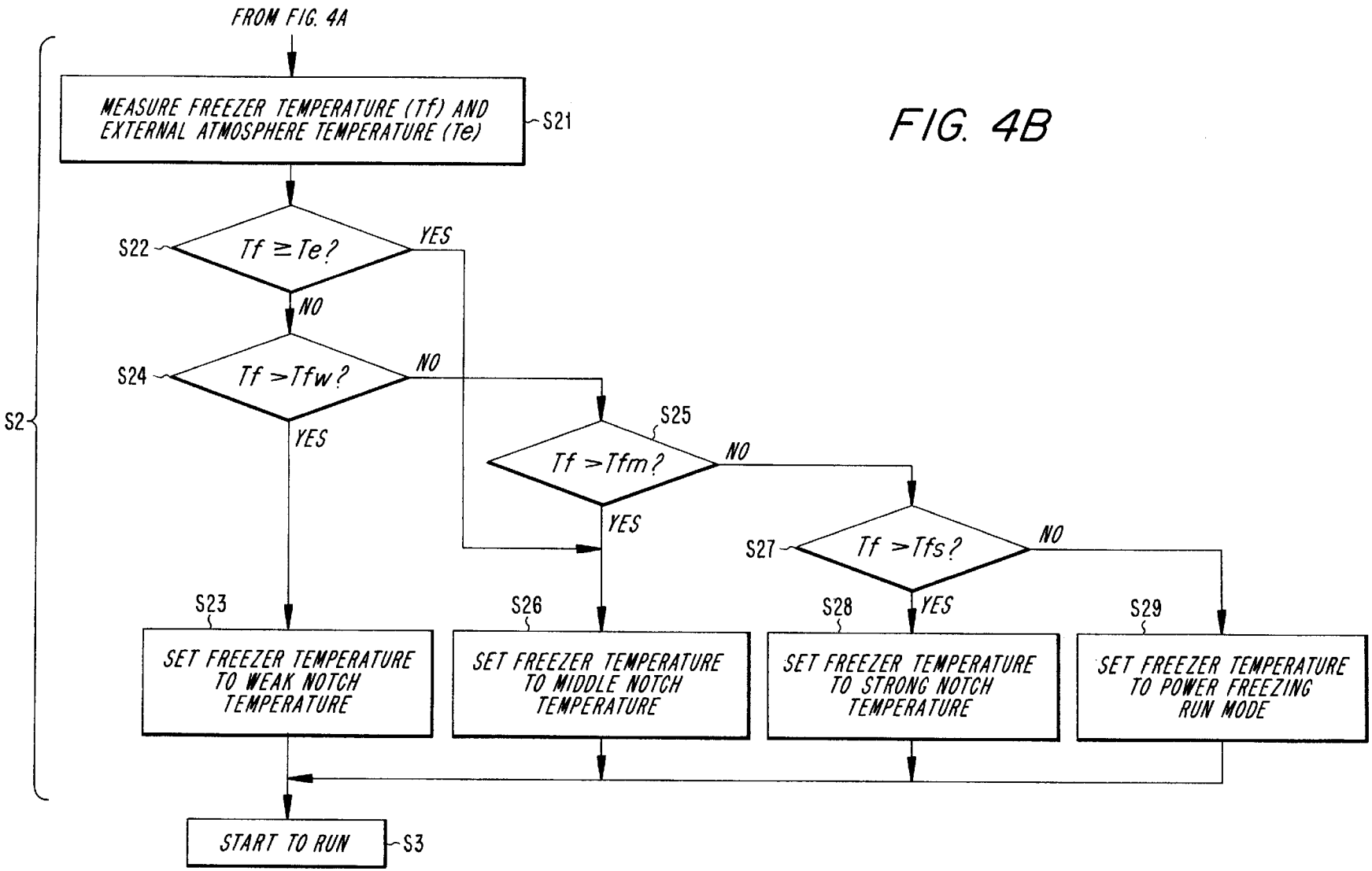

In the present invention, the controller 24 further includes a control routine of a control method for an initial operation of the refrigerator including the steps S1 and S2 of setting cooling temperatures with respect to the respective cooler and freezer immediately after power is applied, and then the step S3 of starting the running of the refrigerator as shown in FIGS. 4A, 4B. In the drawing, the step S2 of setting the cooling temperature in the freezer is performed after the step S1 of setting the cooling temperature of the cooler. However, the sequence thereof can be reversed.

In the steps S1 and S2 of setting the cooling temperatures in the cooler and the freezer (hereinafter, called temperatures in the refrigerator), the temperatures Tr and Tf in the refrigerator and the external atmosphere temperature Te are checked (i.e. sensed) (S11 and S21), and the checked temperatures Tr and Tf in the refrigerator are compared with a reference temperature Tref based upon the external atmosphere temperature. The reference temperature is preferably different from the external atmosphere temperature Te, preferably, Tref equals Te−5° C. (S12 and S22). When the checked temperatures Tr and Tf in the refrigerator are equal to or higher than Tref, it is judged that the power is applied for initial operation, while when the former is lower than the latter, it is judged that the applied power is being applied after a temporary power failure. When the power failure occurs for a relatively short time, the temperatures in the refrigerator are not greatly different from the temperatures set by the user before the power failure. However, when the refrigerator operates for the first time or is not used for a long time, the temperatures of the refrigerator are very similar to the external atmosphere temperature. Thus, the present invention compares the temperatures in the refrigerator with Tref in order to judge whether or not the applied power is due to temporary power failure.

In this procedure, if it is judged that the applied power is not due to a temporary power failure, that is, it is judged that the applied power is for an initial operation of the refrigerator, each of the temperatures in the refrigerator is set to a "middle" notch temperature where the lamp arrays 33 and 34 in the panel 30 shown in FIG. 3 are lit up to the middle notches (S16 and S26).

Meanwhile, if is judged that the applied power is due to temporary power failure, the temperatures Tr and Tf in the refrigerator are compared in turn with the respective notch temperatures in the lamp arrays 33 and 34 in order to estimate a previous temperature condition set by a user, to then set cooling temperatures according to the comparison result. When the cooling temperatures in the refrigerator are set through the above procedure, it is preferable that the cooling temperatures are set at temperatures by a little amount lower than the checked temperatures Tr and Tf in the refrigerator. The reason is because the temperatures in the refrigerator during the temporary power failure will rise higher by a little amount than the cooling temperatures set before the power failure. For this reason, the present invention divides the notches in the lamp arrays 33 and 34 into three pre-selected temperatures such as "strong", "middle" and "weak" and the checked temperatures Tr and Tf in the refrigerator are compared with the "weak" notch temperature values Trw and Tfw at first (S13 and S23). When the checked temperatures are higher than the notch temperature values, the cooling temperatures in the cooler and the freezer are set to the temperatures at which the "weak" notches are lit up in the lamp arrays 33 and 34 (S14 and S24). However, if the temperatures Tr and Tf are equal to or lower than the "weak" notch temperature values Trw and Tfw, the temperatures Tr and Tf in the refrigerator are compared with the "middle" notch temperature values Trm and Tfm (S15 and S25). When the temperatures in the refrigerator are higher than the "middle" notch temperature values, the cooling temperatures are set to the temperatures at which the "middle" notches are lit up in the lamp arrays 33 and 34 (S16 and S26). However, if the temperatures Tr and Tf in the refrigerator are equal to or lower than the "middle" notch temperature values Trm and Tfm, the temperatures Tr and Tf in the refrigerator are compared with the "strong" notch temperature values Trs and Tfs (S17 and S27). When the temperatures in the refrigerator are higher than the "strong" notch temperature values, the cooling temperatures are set to the temperatures at which the "strong" notches are lit up in the lamp arrays 33 and 34 (S18 and S28). If the temperatures Tr and Tf in the refrigerator are equal to or lower than the "strong" notch temperature values Trs and Tfs, the cooler and the freezer are set to a power cooling mode and a power freezing mode, respectively (S19 and S29).

As a result, the checked temperatures in the refrigerator are compared with each notch temperature value in turn to more precisely control a cooling temperature set value, which enables the previous temperature control condition to be more closely attained.

After the cooling temperatures in the cooler and the freezer are completely set, the refrigerator starts to run under the set temperature control condition (S3). After the refrigerator starts to run, the controller 24 of FIG. 2 detects the respective temperatures in the refrigerator from the sensors 21 and 22 on a real time basis, and compares the changed temperatures in the refrigerator with the set cooling temperatures. Thus, the program returns to a conventional control routine in which if the changed temperatures rise up equal to or higher than the set cooling temperatures, the compressor and the blowing fan are driven, while if the former falls down lower than the latter, the compressor and the blowing fan stop.

As described above, according to the present invention, in the case when power is applied due to the temporary power failure not due to an initial operation, a previous temperature control condition set by a user is estimated, and then the operation of the refrigerator is resumed under this condition, which avoids the inconvenience of requiring the user to reset cooling temperatures after power failed. Thus, the present invention is more convenient to the user. Particularly, the present invention avoids a loss of freshness of the foodstuff resulting from an alteration of a temperature control condition in the refrigerator due to temporary power failure.

What is claimed is:

1. A method of automatically setting a refrigerator temperature in response to the application of power thereto, comprising the steps of:

A) sensing a temperature in the refrigerator;

B) sensing an external atmosphere temperature, and supplying a reference temperature based thereon;

C) comparing the sensed refrigerator temperature of step A with the reference temperature of step B;

D) determining that power is being supplied after a temporary power outage, if the sensed refrigerator temperature is less than the reference temperature, or that power is not being supplied after a temporary power outage if the sensed refrigerator temperature is not less than the reference temperature; and E) performing one of two different automatic refrigerator temperature setting operations, depending on whether it is determined that power is or is not being supplied after a temporary power outage.

2. The method according to claim 1 wherein the reference temperature supplied in step B is different from the sensed external atmosphere temperature.

3. The method according to claim 2 wherein the reference temperature is established by subtracting a pre-set error value from the sensed external atmosphere temperature.

4. The method according to claim 3 wherein the pre-set error value is five degrees.

5. The method according to claim 1 wherein the automatic refrigerator temperature setting operation performed when the sensed refrigerator temperature is less than the reference temperature comprises the steps of providing a plurality of pre-selected temperature values, and setting the refrigerator temperature to the highest one of all pre-selected temperature values that are lower than the sensed refrigerator temperature.

6. The method according to claim 5 wherein the pre-selected temperature values comprise a weak value, a middle value, and a strong value.

7. A refrigerator including a refrigerator compartment, a compressor, an evaporator for performing a heat exchange between air and a coolant compressed by the compressor, a fan for blowing heat-exchanged air from the evaporator to the refrigerator compartment, and a control mechanism for automatically setting a refrigerator temperature in response to the application of power thereto, the control mechanism comprising:

first temperature sensing means for measuring a temperature in the food compartment;

second temperature sensing means for sensing an external atmosphere temperature and supplying a reference temperature based thereon;

means for comparing the sensed refrigerator temperature to the sensed external atmosphere temperature; and means for determining that power is being supplied after a temporary power outage if the sensed refrigerator temperature is less than the reference temperature, or that power is not being supplied after a temporary power outage, if the sensed refrigerator temperature is not less than the reference temperature, and means for performing one of two different automatic refrigerator temperature setting operations, depending on whether it is determined that power is or is not being supplied after a temporary power outage.

8. The refrigerator according to claim 7 further including a display for displaying a set refrigerator temperature, and a manual keypad for altering a set refrigerator temperature.

9. The refrigerator according to claim 8 wherein said display and said keypad comprise a single panel.

10. The refrigerator according to claim 9 wherein said display comprises notches spaced apart to indicate a range of temperatures, and a lamp array for illuminating the notches.

* * * * *